US005416926A

United States Patent [19]

Koy

[11] Patent Number: 5,416,926

[45] Date of Patent: May 23, 1995

[54] PRE-TIED NECKTIE KNOT SUPPORT

[76] Inventor: Sherry S. Koy, 21805 Arline Ave., Hawaiian Gardens, Calif. 90716

[21] Appl. No.: 128,292

[22] Filed: Sep. 29, 1993

[51] Int. Cl.[6] ..... A41D 25/02; A41D 25/08

[52] U.S. Cl. ..... 2/153; 2/145; 2/148; 2/149; 2/150; 2/152.1

[58] Field of Search ..... 2/145, 149, 150, 152 R, 2/152 A, 153, 52, 144, 146, 147, 148, 149, 152.1, 154, , 155, 156, 157

[56] References Cited

U.S. PATENT DOCUMENTS 2,796,612 6/1957 Bourgeois ..... 2/153
4,513,453 4/1985 Chen et al. ..... 2/153 X
4,897,887 2/1990 Chen et al. ..... 2/153 X
5,048,127 9/1991 Yang ..... 2/153 X
5,170,507 12/1992 Langford et al. ..... 2/153 X

*Primary Examiner*—Jeanette E. Chapman
*Attorney, Agent, or Firm*—John B. Dickman, III

[57] ABSTRACT

A necktie knot supporting means having a triangular shaped front face with a V-shaped upper portion to form a tighter knot and hide the back portion of the knot and a pair of upwardly inclined upstanding walls. A necktie loop having a zipper to tighten the loop and a necktie front panel fixed to the triangular shaped front face for tying a knot about the knot supporting means. An inclined braking area and a pinching area to give the tie a more natural look are also included.

5 Claims, 2 Drawing Sheets

PRE-TIED NECKTIE KNOT SUPPORT

BACKGROUND OF THE INVENTION

The present invention relates generally to pre-tied neckties and, more particularly, to a pre-tied necktie knot support.

Heretofore, neckties were tied each time they were worn. When a necktie is tied and untied, the area where the knot is formed often becomes wrinkled or distorted. In addition, the user seldom ties the same knot each time, leading to misshaped knots. There have been at least two solutions to these problems: the well known clip on necktie, and the more recent necktie having a pre-tied knot which fits around the user's neck and is adjustable by a means of a slidable zipper. Such a necktie is described in other U.S. Patents, including U.S. Pat. No. 3,942,192, U.S. Pat. No. 4,656,672 and U.S. Pat. No. 5,048,127. The U.S. Pat. No. 3,942,192 has a knot supporting means with a necktie front panel permanently attached to it and tied into a knot. A neck loop is slidably attached to the knot supporting means to adjust the size of the loop to fit around a user's neck. The neck loop has a zipper sewn to the inner edge of the loop. There is a zipper slide gripping tab which secures the neck loop to the knot supporting means by a bracket and a protuberance to adjust the loop size.

Another pre-tied necktie is shown in U.S. Pat. No. 4,656,672 where the zipper slide is secured to a knot supporting means. The zipper slide has an elongated hooking member with a through hole in which a gripper tab is normally mounted. The gripper tab is removed so that the elongated hooking member will snap into a slot in the knot supporting member to adjust the size of the necktie loop.

In U.S. Pat. No. 5,048,127, the zipper slide attaches to the knot supporting member similar to the one in U.S. Pat. No. 3,942,192, where the gripping tab is secured to the knot supporting member by a bracket and a protuberance.

The knot supporting member, in most all of the prior art, has a generally triangular shape with a means to support the knot formed by the permanently attached nectie panel, and guide the neck loop. In addition to the above listed patents, U.S. Pat. Nos. 4,513,453 and 4,710,982 are of interest to the present invention. These patents describe a knot supporting member having a generally triangular shape with a closed loop projecting from it to guide a necktie loop. The face of the knot supporting member, the triangular-shape, has an arcuate curve with the closed loop having the same arcuate curve parallel to the arcuate curve of the face.

SUMMARY OF THE INVENTION

The present invention provides a knot supporting means for a pre-tied necktie which combines a zipper slide securing means and a triangular shaped knot supporting member with a closed loop to support a necktie knot and a necktie adjustable loop. The knot supporting means has a front face with a generally triangular shape. The lower portion of the front face has a tongue with a protuberance and a bracket to receive and secure a zipper slide gripping tab. Other securing means may be used, such as a split rivit on the tongue.

An alternative method of securing the zipper tab to the necktie knot support is to form a split stud or rivet in place of the solid post or protuberance 42 in FIG. 3, said split stud expanding after passing through aperture 44 in the tab 38, thus making a more secure connection.

The triangular shaped face of the knot supporting member is flat with the exception of the bottom tongue area which slants slightly inward to provide an area for the pinching of the tie. The pinching of the tie creates a natural looking fold similar to those found in hand tied ties and has a pair of upstanding walls integral with the triangular shaped face card extending toward the back. The upstanding walls have tapered edges extending upwardly from the tongue to the top of the triangular shaped knot supporting member. The inclination of the upstanding walls provides a wider and thicker area near the top of the triangular shaped knot support member and a narrower thinner area at its bottom. The effect of the inclination is to provide a supporting member for tying a necktie knot of almost ideal proportions, thick at the top and narrow at the bottom. A "braking" area 27 adds friction so the tie will not slip when the loop is opened and closed. This "braking" action occurs due to the restricted space formed by the tapering walls of the knot supporting member.

DESCRIPTION OF THE INVENTION

Figure 1:
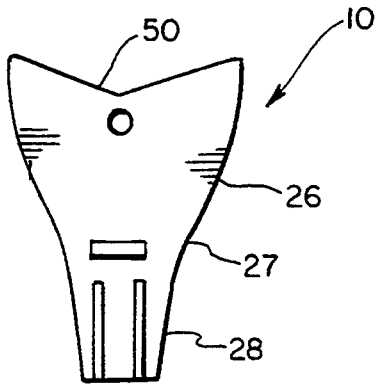
FIG. 1 is a front plan view of a necktie support of the invention.
Figure 6:
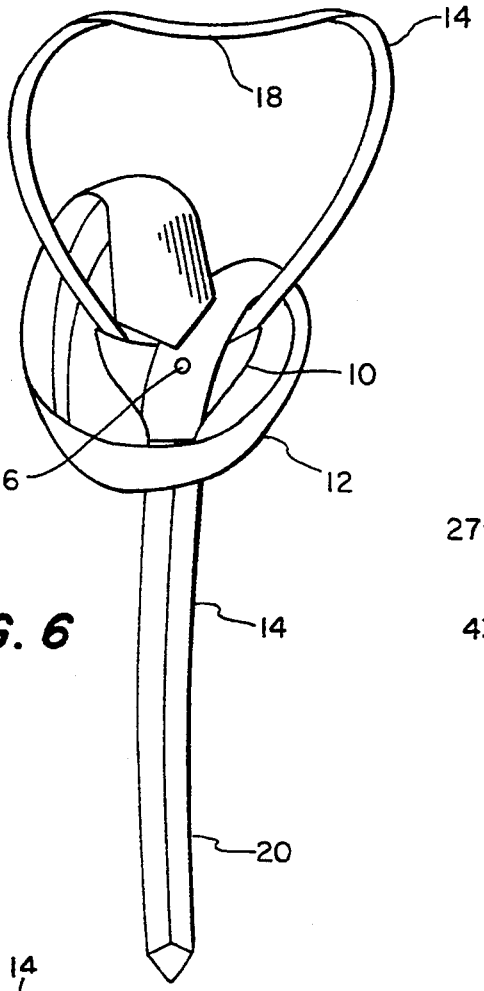
FIG. 6 is a front view illustrating the wrapping of the front tie portion about a rigid knot support to form a knot.
Figure 7:
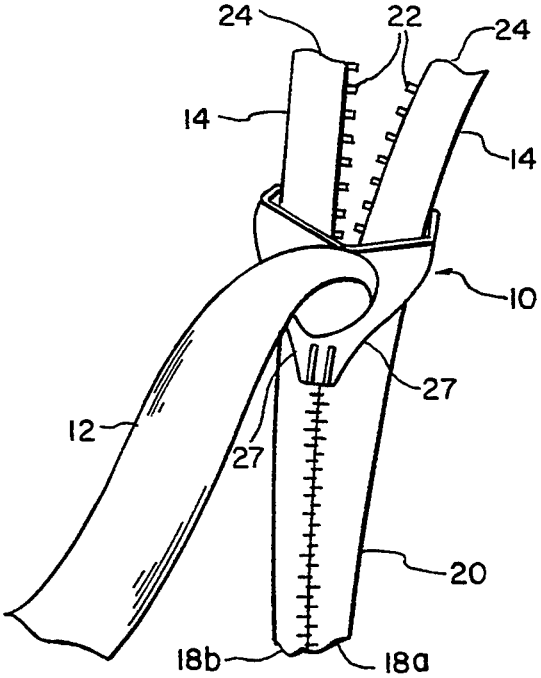
FIG. 7 is a partial perspective view of FIG. 6 before the front tie portion is wrapped around the knot support to form a knot.

Referring to the drawings FIGS. 1–9 the necktie of the invention has a rigid knot supporting means 10 shown in FIG. 1. In FIGS. 6 and 7 a necktie is shown having a front panel 12 and a neck embracing loop 14, hereinafter referred to as a neck loop, being tied about a rigid knot supporting means 10 by a rivit 16. Front panel 12 is wrapped around the rigid knot supporting means 10 to form a knot portion. The neck loop 14 has a loop 18, with a lower end designated as 20 which extends through an opening formed by the rigid knot supporting means 10 and front panel 12.

The neck loop 14 may be made from a single slide fastener stringer or loop 18 which is provided with a continuous string 22 of slide fastener coupling elements of identical construction along an edge of the loop. A border 24 of similar material as the front tie panel 12 is sewn along the side of loop 18.

Figure 8:
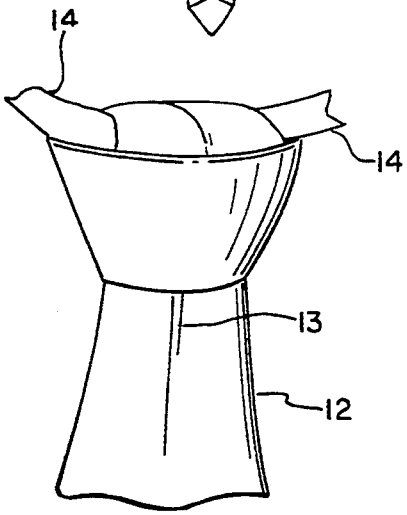
FIG. 8 is a front view of a completed knot of the necktie.

The front panel 12 and the neck loop 14 are not shown in FIGS. 1–4 which illustrate the rigid knot supporting means 10. The rigid knot supporting means 10 has a triangular shaped front face 26, which tapers downwardly to a tongue portion 28. Portion 28 slopes inward to provide an area for the pinching of the tie as shown in FIG. 8. A zipper slide fastener 30, FIG. 5, of well known construction is secured within a cavity 32 formed by a front face 26 and a pair of matching upstanding walls 34 and 36, best shown in FIG. 4. The slide fastener 30 is attached to a gripping tab 38 which is removably attached to the tongue portion 28 of the rigid knot supporting means 10.

Gripping tab 38 is attached to the tongue portion 28 by bracket 40 molded on the back side of tongue portion. Positioned below the bracket 40 is an inclined post or protuberance 42 to engage hole 44 in gripping tab 38. The gripping tab 38 is slid into bracket 40 and forced over inclined post 42 to where hole 44 engages the post. To remove the zipper slide fastener 30, the gripping tab 38 is pried off the post 42 and then pulled up through the bracket 40. A split stud 43 can be substituted for post 42 if desired.

The neck loop 14 having a loop 18 with ends 18*a* and 18*b* of the loop are manipulated so that the ends are pushed through respective openings 30*a* and 30*b* of zipper slide fastener 30 to interlock opposing coupling elements 22 of the single slide fastener loop. In this way not only is the loop 18 formed but also lower end 20.

In order to wear the necktie described, the knot portion is gripped with one hand and lower end 20 with the other. Should the loop not be sufficiently large enough to pass over the head, knot portion is pulled while holding loop 18. The necktie is snuggled around the neck as described and removed by reversing the operation.

Figure 4A:
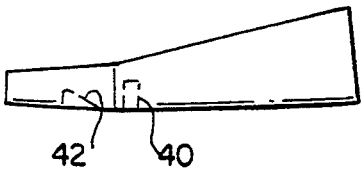
FIG. 4*a* is a side view of the necktie knot support of FIG. 1.
Figure 10:
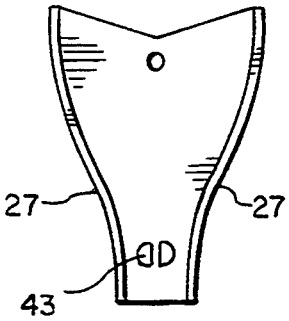
FIG. 10 is a front view of the device showing the split rivet form of attaching stud.
Figure 10A:
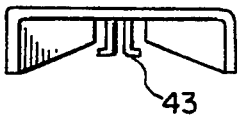
FIG. 10A is an end view showing the split rivet form of attaching stud.

A closer look at the knot supporting means 10 shows the cavity 32 provided by the face portion 26 and upstanding walls 34 and 36. Cavity 32 furnishes the open area between the knot supporting means 10 and necktie front panel 12, when wrapped into a knot for loop 14 to slide in. Upstanding walls 34 and 36, are identically inclined as shown in FIG. 4a, starting where tongue portion 28 joins the triangular shaped front face 26 and increasing in width to top edge 46. The inclination the upstanding walls 34 and 36 helps to create a near to perfect necktie knot as in FIGS. 8 and 9. A "braking area" 27 adds friction so the tie will not slip when the loop is opened and closed. This "breaking" action occurs due to the restricted space formed by the tapering walls of the know supporting member. FIG. 8 shows a necktie knot which follows the outline of the triangular shaped front face 28. While in FIG. 9 the side of the necktie knot has the general shape of the inclined upstanding walls 34 and 36.

Figure 2:
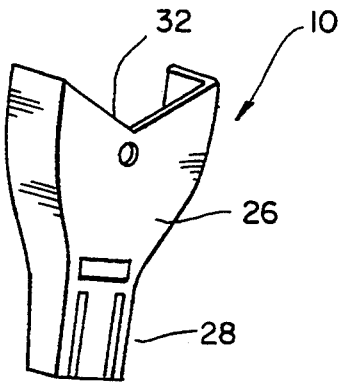
FIG. 2 is a perspective view of the necktie knot support of FIG. 1.
Figure 3:
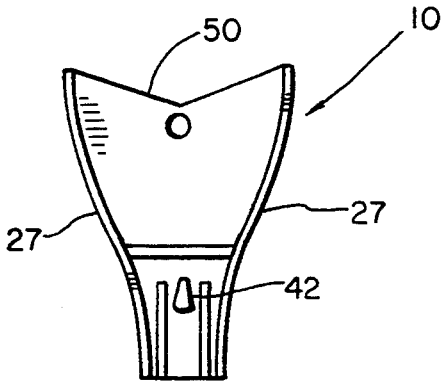
FIG. 3 is a back plan view of the necktie knot support of FIG. 1.
Figure 4:
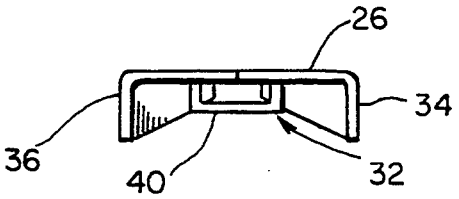
FIG. 4 is a top plan view of the necktie knot support FIG. 1.
Figure 5:
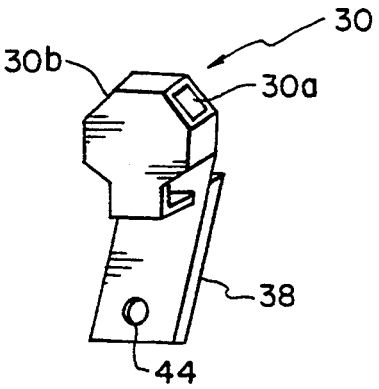
FIG. 5 is a perspective view of a zipper slide fastener.
Figure 9:
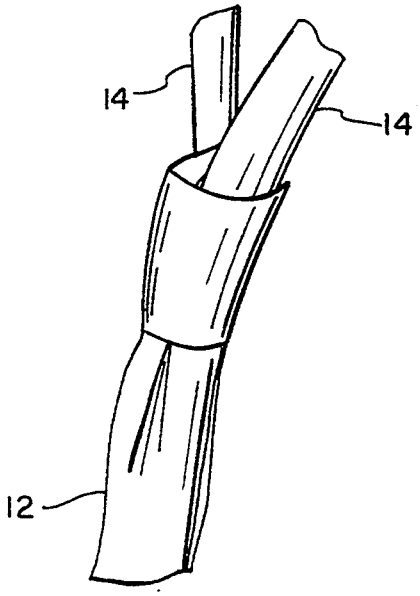
FIG. 9 is a side view of a completed knot of a necktie according to the invention.

FIGS. 1–3 show the triangular shaped front face 26 having a V-shaped upper end 50. The purpose of the V-shaped upper end is to conceal the top of the back portion of the knot. Front panel 12 is affixed to triangular shaped front face 26 by a rivet 16. The front panel 12 is wrapped around one of the loop ends 14, across the front of front face 26, and around the other loop end 14. The free end of front panel 12 is inserted through the loop formed across the front of front face 26 and pulled down to form the knot shown in FIGS. 8 and 9. V-shaped upper end 50 to be drawn tight against it, forming a natural looking fold 13, and thereby reducing the amount of front panel exposed above the knot. This also helps to tie a tighter and more secure knot.

While only one embodiment of the invention has been disclosed, one should study the drawings, description and claims for a complete understanding of the invention.

I claim:

1. A necktie in combination with a rigid knot supporting means comprising; a first tie portion having a neck embracing loop including lower, inner edges provided with interlockable means; means on said knot supporting means and operatively connected to said interlockable means for interlocking and unlocking said interlockable means and said interlocking and unlocking means to vary the size of the loop; and a second tie portion having an upper end thereof secured to said knot supporting means to form a knot portion, and the remainder thereof depending from said knot supporting means to form a front, depending panel; said knot supporting means having a triangular shaped front face means, with a top end and a lower end, a tongue portion extending downwardly from said triangular shaped front face means lower end; a pair of upstanding wall means on said triangular shaped front face means, where said upstanding wall means are inclined upwardly from said tongue portion to said triangular shaped front face means top end, whereby a necktie knot is formed about said knot supporting means being wider along said top end of said triangular shaped front face means, and on said upstanding wall means where said triangular shaped front face means top end and said upstanding wall means join, then at said tongue portion, said rigid knot supporting means further including an inclined portion formed between the lower end of said triangularly shaped portion and said tongue portion, whereby a frictional braking action will occur when said tie is moved upwardly and downwardly.

2. Said necktie having a rigid knot supporting means as in claim 1 wherein said triangular shaped front face means having a V-shaped upper end to reduce the second tie portion exposed above said V-shaped upper end and enable the user to tie a tighter more secure knot.

3. Said necktie in combination with a rigid knot supporting means as in claim 1 wherein said means operatively connected to said interlockable means is a zipper fastener means.

4. Said necktie in combination with a rigid knot supporting means as in claim 3 wherein said zipper fastener means is removable from said knot supporting means.

5. Said necktie in combination with a rigid knot supporting means as in claim 1 in which said front face means has a slightly angled surface to cause the portion of the tie below the knot to be pinched and form a crease, simulating a regular tied tie.

* * * * *